US009491806B2

(12) United States Patent
McCarthy

(10) Patent No.: US 9,491,806 B2
(45) Date of Patent: Nov. 8, 2016

(54) HEATABLE TRANSPARENCY

(75) Inventor: William Casey McCarthy, North Hills, CA (US)

(73) Assignee: PPG Industries Ohio, Inc., Cleveland, OH (US)

( * ) Notice: Subject to any disclaimer, the term of this patent is extended or adjusted under 35 U.S.C. 154(b) by 294 days.

(21) Appl. No.: 13/249,861

(22) Filed: Sep. 30, 2011

(65) Prior Publication Data

US 2013/0082043 A1 Apr. 4, 2013

(51) Int. Cl.

*B60L 1/02* (2006.01)
*H05B 3/02* (2006.01)
*H05B 3/84* (2006.01)

(52) U.S. Cl.

CPC ..... *H05B 3/84* (2013.01); *H05B 2203/005* (2013.01); *H05B 2203/013* (2013.01)

(58) Field of Classification Search

CPC ..... H05B 3/84; H05B 2203/005; H05B 2203/013
USPC ..... 219/203, 522, 541
See application file for complete search history.

(56) References Cited

U.S. PATENT DOCUMENTS

| | | | | |
|---|---|---|---|---|
| 3,313,920 | A | 4/1967 | Glaverbel | |
| 3,789,191 | A | 1/1974 | Spindler | |
| 3,789,192 | A | 1/1974 | Spindler | |
| 3,790,752 | A | 2/1974 | Boaz et al. | |
| 3,794,809 | A | 2/1974 | Beck et al. | |
| 3,974,359 | A * | 8/1976 | Orcutt et al. | 219/522 |
| 4,543,466 | A | 9/1985 | Ramus | |
| 4,610,771 | A | 9/1986 | Gillery | |
| 4,623,389 | A | 11/1986 | Donley et al. | |
| 4,806,220 | A | 2/1989 | Finley | |
| 4,820,902 | A | 4/1989 | Gillery | |
| 4,894,513 | A | 1/1990 | Koontz | |
| 4,902,875 | A | 2/1990 | Koontz | |
| 4,994,650 | A | 2/1991 | Koontz | |
| 5,213,828 | A | 5/1993 | Winter et al. | |
| 5,675,944 | A | 10/1997 | Kerr et al. | |
| 5,821,001 | A | 10/1998 | Arbab et al. | |
| 6,369,369 | B2 * | 4/2002 | Kochman et al. | 219/545 |
| 6,559,419 | B1 * | 5/2003 | Sol | B32B 17/10192 219/203 |
| 7,132,625 | B2 | 11/2006 | Voeltzel | |
| 2004/0065651 | A1 | 4/2004 | Voeltzel | |
| 2005/0045613 | A1 * | 3/2005 | Maeuser | B32B 17/10036 219/203 |
| 2007/0278200 | A1 * | 12/2007 | Muromachi et al. | 219/203 |
| 2010/0159251 | A1 | 6/2010 | Brandt | |

FOREIGN PATENT DOCUMENTS

| | | | | |
|---|---|---|---|---|
| BE | 647 317 A | | 10/1964 | |
| GB | 2186769 A | * | 8/1987 | B32B 17/10174 |
| JP | 2 046663 A | | 2/1990 | |

OTHER PUBLICATIONS

PCT Search Report, PCT/US2012/054189, dated Dec. 10, 2012.

* cited by examiner

*Primary Examiner* — David Angwin
*Assistant Examiner* — Amit K Singh
(74) *Attorney, Agent, or Firm* — Andrew C. Siminerio

(57) ABSTRACT

An aircraft transparency has a heatable member to remove fog, ice and snow from the outer surface of the transparency. The heatable member includes a pair of spaced parallel bus bars with the ends of the bus bars offset from one another, and a coating including a plurality of spaced segments of an electrically conductive coating electrically connecting the bus bars. The ratio of the major diagonal to the minor diagonal is in the range of greater than 1 to 1.25 to more uniformly heat the coating and the outer surface of the transparency.

9 Claims, 4 Drawing Sheets

HEATABLE TRANSPARENCY

FIELD OF THE INVENTION

This invention relates to a heatable transparency, e.g. a vehicle transparency, and in particular to a heatable aerospace, e.g. an airplane windshield.

DISCUSSION OF THE TECHNOLOGY

Heatable transparencies, e.g. windshields for vehicles, e.g. airplanes and automobiles, are disclosed, among other places, in U.S. Pat. Nos. 3,789,191; 3,789,192; 3,790,752; 3,794,809; 4,543,466; 4,820,902; 5,213,828 and 7,132,625, which patents in their entirety are hereby incorporated by reference. In general a pair of spaced bus bars is applied to a surface of a glass or plastic sheet and an electrically conductive member is applied onto the surface between and in electrical contact with the bus bars. Thereafter, the glass or plastic sheet having the heatable member is laminated to another glass or plastic sheet by a plastic interlayer. The conductive member is usually an evaporated, sputtered, or pyrolytic electrically conductive coating, e.g. of the type sold by PPG Industries, inc. under the registered trademarks NESATRON and NESA.

Usually, the aircraft and automotive windshield has a generally trapezoidal peripheral shape, and the outer major surface of the windshield as mounted in the aircraft or automobile is convex with the upper portion of the windshield having the shorter length. Usually, the conductive member follows the peripheral outline of the windshield and is spaced from the peripheral edges of the sheet on which it is applied. Because of the peripheral shape of the windshield, the electrically conductive coating is either between and connected to a pair of spaced bus bars of different lengths having the ends of the smaller bus bar within the boundaries set by the ends of the longer bus bar, or the coating is between and connected to a pair of spaced bus bars having the ends of the bus bars offset from one another with only one end of a bus bar within the boundary defined by the ends of the other bus bar.

The problems associated with the above type of heating arrangements are non-uniform heating of the windshield surfaces and reduced efficiency in the removal of condensation and/or ice that forms outside the boundaries of the smaller bus bar. The problems associated with the coating between a pair of spaced bus bars of different lengths having the ends of the smaller bus bar within the boundaries set by the ends of the longer bus bar are discussed, and solutions to solve the problems presented, in U.S. Pat. No. 7,132,625.

The problems associated with having a conductive coating between and connected to spaced bus bars where the spaced bus bars are of equal length, or unequal length, and have the ends of the bus bars offset from one another with only one end of a bus bar within the boundary defined by the ends of the other bus bar are not discussed in the art, nor is a solution to the problem provided in the art. In view of the foregoing, it can now be appreciated by those skilled in the art that it would be advantageous to provide a heatable member, e.g. a heatable transparency, e.g. an aircraft windshield having a conductive coating between and connected to a pair of spaced bus bars where the ends of the spaced bus bars are offset from one another with only one end of a bus bar within the boundaries defined by the ends of the other bus bar that provides uniform heating of the conductive coating to remove condensation and/or ice that would otherwise not be removed from areas along the top and bottom surface of the windshield.

SUMMARY OF THE INVENTION

This invention relates to an improved heatable member of the type having a dielectric substrate having a major surface having a first bus bar and a spaced second bus bar, and an electrically conductive coating between and in electrical contact with the bus bars, the first bus bar having a first end and an opposite second end, and the second bus bar having a first end and an opposite second end, wherein the first and the second ends of the first bus bar are offset from the first and the second ends of the second bus bar and the coating is a continuous electrically conductive coating. The improvement of the invention includes, among other things, the coating having, among other things, a plurality of electrically conductive segments, each of the segments comprising a first end and an opposite second end, wherein the first end of each of the segments is in electrical contact the first bus bar, the second end of each of the segments is in electrical contact with the second bus bar, and portions of each of the segments between the first bus bar and the second bus bar in spaced relationship to one another to prevent electrical contact between adjacent ones of the segments between the bus bars, wherein a ratio of a major diagonal to a minor diagonal is greater than 1.

The invention further relates to an aircraft window having a first major surface and an opposite second major surface and a heatable member between the first and the second major surfaces. The heatable member includes, among other things, a first bus bar and a spaced second bus bar, and an electrically conductive coating between and in electrical contact with the bus bars, the first bus bar having a first end and an opposite second end, and the second bus bar having a first end and an opposite second end, wherein the first and the second ends of the first bus bar are offset from the first and the second ends of the second bus bar. A coating includes, among other things, a plurality of electrically conductive segments, each of the segments comprising a first end and an opposite second end, wherein the first end of each of the segments is in electrical contact the first bus bar, the second end of each of the segments is in electrical contact with the second bus bar, and portions of each of the segments between the first bus bar and the second bus bar in spaced relationship to one another to prevent electrical contact between adjacent ones of the segments between the bus bars, wherein a ratio of a major diagonal to a minor diagonal is greater than 1.

DETAILED DISCUSSION OF THE INVENTION

Figure 1:
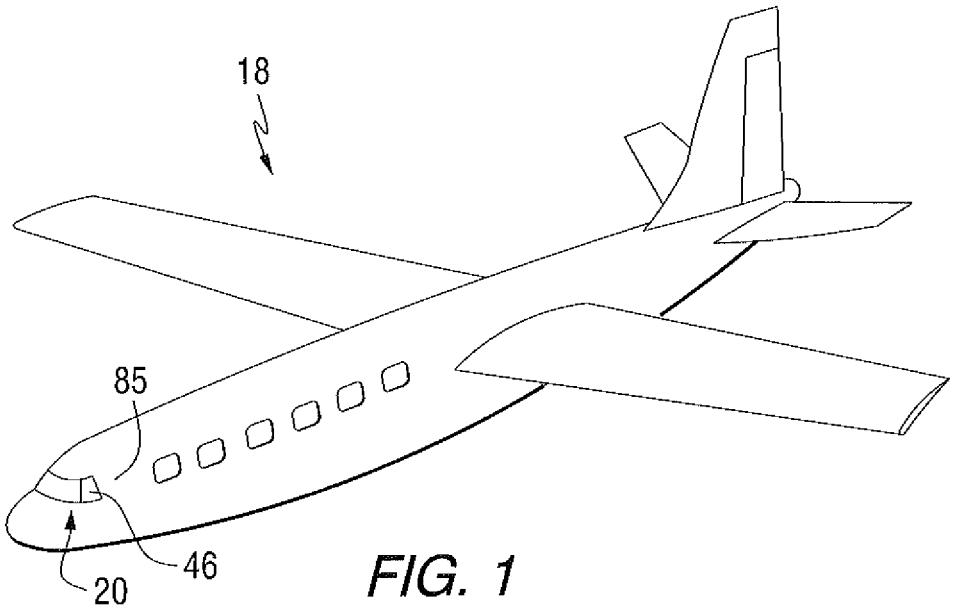
FIG. 1 is an isometric view of an aircraft incorporating features of the invention.

As used herein, spatial or directional terms such as "inner", "outer", "left", "right", "up", "down", "horizontal", "vertical", and the like, relate to the invention as it is shown in the drawing on the figures. However, it is to be understood that the invention can assume various alternative orientations and, accordingly, such terms are not to be considered as limiting. Further, all numbers expressing dimensions, physical characteristics, and so forth, used in the specification and claims are to be understood as being modified in all instances by the term "about". Accordingly, unless indicated to the contrary, the numerical values set forth in the following specification and claims can vary depending upon the property desired and/or sought to be obtained by the present invention. At the very least, and not as an attempt to limit the application of the doctrine of equivalents to the scope of the claims, each numerical parameter should at least be construed in light of the number of reported significant digits and by applying ordinary rounding techniques. Moreover, all ranges disclosed herein are to be understood to encompass any and all subranges subsumed therein. For example, a stated range of "1 to 10" should be considered to include any and all subranges between and inclusive of the minimum value of 1 and the maximum value of 10; that is, all subranges beginning with a minimum value of 1 or more and ending with a maximum value of 10 or less, e.g., 1 to 6.7, or 3.2 to 8.1, or 5.5 to 10. Also, as used herein, the term "positioned over" or "mounted over" means positioned on or mounted over but not necessarily in surface contact with. For example, one article or component of an article "mounted over' or positioned over" another article or component of an article does not preclude the presence of materials between the articles, or between components of the article, respectively.

Before discussing several non-limiting embodiments of the invention, it is understood that the invention is not limited in its application to the details of the particular non-limiting embodiments shown and discussed herein since the invention is capable of other embodiments. Further, the terminology used herein to discuss the invention is for the purpose of description and is not of limitation. Still further, unless indicated otherwise, in the following discussion like numbers refer to like elements.

Non-limiting embodiments of the invention will be directed to aircraft laminated transparencies, and in particular, to an aircraft windshield. The invention, however, is not limited to any particular type of aircraft and/or aircraft transparency, and the invention can be practiced on any type of aircraft and/or aircraft transparency having a heatable member to heat a surface, usually the outer surface of the transparency. Further, the invention can be practiced on commercial and residential windows, e.g. but not limited to the type disclosed in U.S. Pat. No. 5,675,944, which patent in its entirety is hereby incorporated by reference; a window for any type of land vehicle; a canopy, cabin window and windshield for any type of air and space vehicle, a window for any above or below water vessel, and a window for a viewing side or door for any type of containers, for example but not limited to a refrigerator, cabinet and/or oven door. Still further, the invention is not limited to the material of the layers or sheets of the aircraft window, and the layers or sheets can be made of, but not limited to, cured and uncured plastic sheets; annealed, heat strengthened, and heat and chemically strengthened, clear, colored, coated and uncoated glass sheets.

Figure 2:
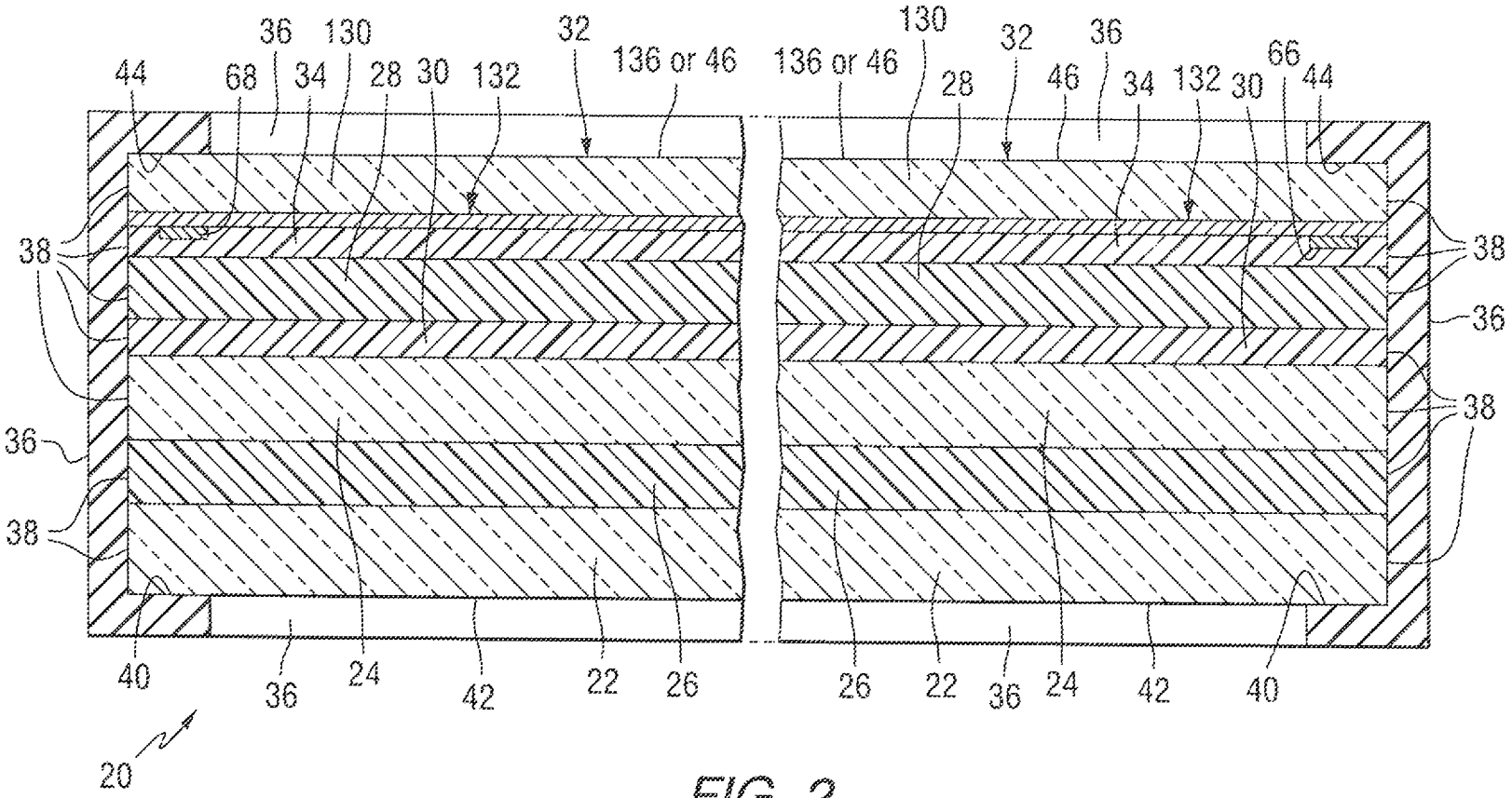
FIG. 2 is a cross sectional elevated view of an aircraft windshield incorporating features of the invention.

Shown in FIG. 1 is an aircraft 18 having a non-limiting embodiment of an aircraft transparency 20 of the invention. With reference to FIG. 2, the windshield 20 includes a first transparent sheet 22 secured to a second transparent sheet 24 by a first vinyl-interlayer 26; the second sheet 24 secured to a second vinyl-interlayer 28 by a first urethane interlayer 30, and the second vinyl-interlayer 28 secured to a heatable member 32 (see FIG. 3) incorporating features of the invention by a second urethane interlayer 34. An edge member or moisture barrier 36 of the type used in the art, e.g. but not limited to a silicone rubber or other flexible durable moisture resistant material is secured to (1) peripheral edge 38 of the windshield 20, i.e. the peripheral edge 38 of the first and second sheets 22, 24; of the first and second vinyl-interlayers 26, 28, and the first and second urethane interlayers 30, 34 and of the heatable member 32; (2) margins or marginal edges 40 of inner surface 42 of the windshield 20, i.e. the margins 40 of the outer surface 42 of the first glass sheet 22 of the windshield 20, and (3) margins or marginal edges 44 of outer surface 46 of the windshield 20, i.e. margins of the outer surface 46 of the heatable member 32.

As is appreciated by those skilled in the art and not limiting to the invention, the first and second glass sheets 22, 24; the first and second vinyl-interlayers 26, 28 and the first urethane interlayer 30 form the structural part, or inner segment, of the windshield 20, and the outer surface 42 of the glass sheet 22 of the windshield 20 faces the interior of the aircraft 18 (hereinafter the outer surface 42 of the glass sheet 22 is also referred to as the inner surface 42 of the windshield 20), and the second urethane layer 34 and the heatable member 32 form the non-structural part, or outer segment, of the windshield 20, and the surface 46 of the heatable member 32 of the windshield 20 faces the exterior of the aircraft 18. The heatable member 32 provides heat to prevent fog from forming on, to remove fog from, to prevent ice from forming on, and/or to melt ice on, the outer surface 46 of the heatable member 32 of the windshield 20 (hereinafter the outer surface 46 of the heatable member 32 is also referred to as the outer surface 46 of the windshield 20) in a manner discussed below.

As can be appreciated, the invention is not limited to the construction of the windshield 20 and any of the constructions of aircraft windshields used in the art can be used in the practice of the invention. For example and not limiting to the invention, the windshield 20 can include a construction wherein the second vinyl interlayer 28 and the first urethane interlayer 30 are omitted, and/or the sheets 22 and 24 are glass or plastic sheets. Generally the sheets 22 and 24 of the windshield 20 are clear chemically strengthened glass sheets; however, the invention is not limited thereto, and the glass sheets 22 and 24 can be heat strengthened or heat tempered glass sheets. Further as is appreciated by those skilled in the art, the invention is not limited to the number of glass sheets, vinyl interlayers, or urethane interlayers that make up the windshield 20, and the windshield 20 can have any number of sheets and/or interlayers and any combinations thereof.

Figure 4:
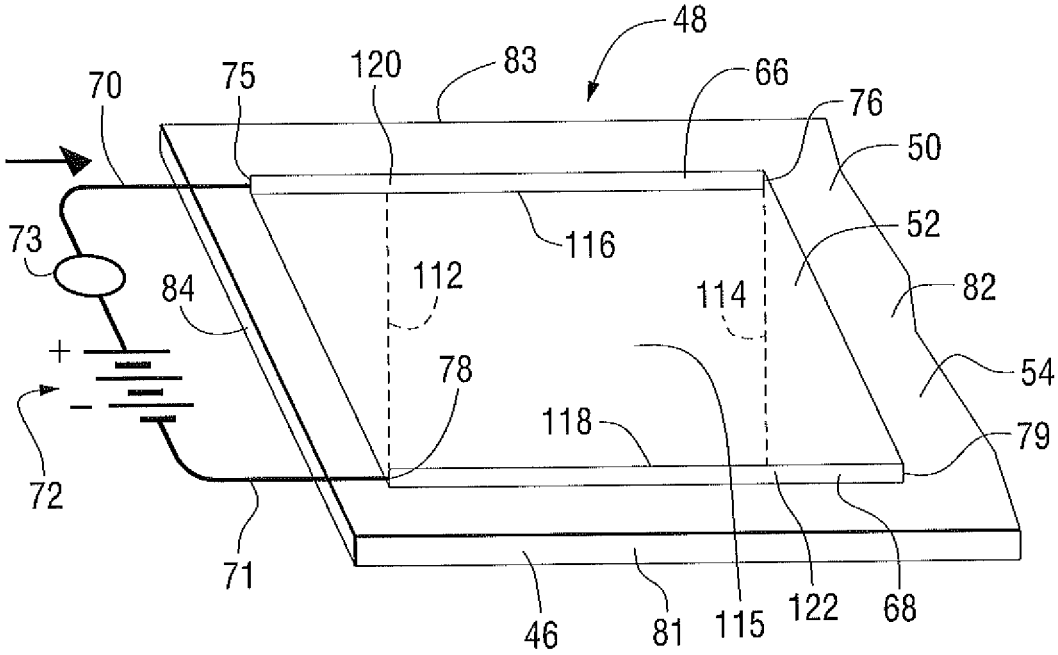
FIG. 4 PRIOR ART
FIG. 4 is a view similar to the view of FIG. 3 showing a prior art heating member.

With reference to FIG. 4, there is shown a prior art heatable member 48 (heatable member 48 of the prior art is replaced by the heatable member 32 (see FIG. 3) of the invention). The heatable member 48 includes a glass sheet 50 having a conductive coating 52 applied to surface 54 of the glass sheet 50, and a pair of spaced bus bars 66, 68 in electrical contact with the conductive coating 52. Each of the bus bars 66 and 68 are connected by a wire 70 and 71, respectively, to an electrical power source 72, e.g. a direct current battery and/or an alternating current electric generator of the airplane 18 to pass current through the bus bars 66 and 68, and the conductive coating 62 to heat the conductive coating 52 and the sheet 50 to prevent the formation of fog and/or ice on, and to remove ice and/or fog from, the outer surface of the windshield, e.g. the surface 46 of the windshield 20.

An on-off switch and a rheostat or variable transformer 73 is connected to one of the wires, e.g. the wire 71 to position the on-off switch and the rheostat or variable transformer 73 between the power source 72 and the bus bar 68 to vary or regulate the current flow through the bus bars 68 and 66, and the conductive coating 52 to control the temperature of the heatable member 48. Preferably the ends 75 and 76 of the bus bar 66, ends 78 and 79 of the bus bar 68 and the conductive coating 52 are spaced from adjacent sides 81-84 of the glass sheet 50 to prevent arcing of the bus bars 66 and 68 with metal body cover 85 of the aircraft 18 (see FIG. 1).

With continued reference to FIG. 4, the bus bars 66 and 68 have the same length, as measured between the ends 75 and 76 of the bus bar 66 and as measured between the ends 78 and 79 of the bus bar 68, and the bus bars 66 and 68 are parallel to one another. For purpose of discussion and not limiting to the invention, the bus bar 66 is designated as the top bus bar, and the bus bar 68 is designated as the bottom bus bar, as the heatable member 48 is mounted in the airplane 18. The ends 75 and 76 of the top bus bar 66 are offset from the ends 78 and 79 of the bus bar 68, and only one end of a bus bar, e.g. the end 78 of the bus bar 68 is between the boundaries set by the ends of the other bus bar, e.g. the ends 75 and 76 of the bus bar 66. The boundary of an end of a bus bar is set by an imaginary line (dotted lines 112 and 114) generally normal to the longitudinal axis of the bus bar and extending from the end of the bus bar to the other bus bar. The longitudinal axis of the bus bar is defined as a straight line drawn from the midpoint of one end, e.g. the end 74 of the bus bar 68 or the end 75 of the bus bar 66, to the midpoint of the other end, e.g. the end 79 of the bus bar 68, or the end 76 of the bus bar 66, respectively. Stated another way, the ends of the bus bars are offset from one another when the ends of two bus bars are not vertically aligned.

U.S. Pat. No. 7,132,625 relates to heatable windshields having a pair of spaced bus bars with the ends of the shorter bus bar within the boundaries set by the ends of the longer bus bar. Further, U.S. Pat. No. 7,132,625 discloses in column 6, line 38 to column 7, line 15, that the watt density of a conductive coating at a longer bus bar is different than the watt density of the coating at an opposite shorter bus bar. The forging is correct when the ends of the shorter bus bar are with the boundaries set by the ends of the longer bus bar, however, the forgoing is not considered correct when the bus bars are offset from one another with only one end of one bus bar within the boundaries set by the ends of the other or opposite bus bar. More particularly, if the forgoing was correct for the situation when the bus bars are offset from one another with only one end of one bus bar within the boundaries set by the ends of the other bus bar, It would be expected that the conductive coating 52 (see FIG. 4) will be uniformly heated between the bus bars 66 and 68 because the watt density of the conductive coating 52 at the top bus bar 66 is equal to the watt density at the bottom bus bar 68.

It has been observed, however, that center portion 115 of the coating 52 of the heatable member 48 outlined by the imaginary lines 112 and 114 between the bus bars 66 and 68, the portion of the bus bar 66 (identified by the number 116) between the end 76 of the bus bar 66 and the imaginary line 112, and the portion of the bus bar 68 (identified by the number 118) between the end 78 and the imaginary line 114 is uniformly heated, and the portions of the coating outside of the center portion 115 are heated to a temperature less than the temperature of the center portion 115 and that the end 76 and the end 78 of the upper and lower bus bars 66 and 68, respectively, draw all of the current from the areas outside of center portion 115. The result is presence of fog, snow and ice, (depending on the weather condition) at portions of the window 20 outside of the center portion 115, which reduces the area of visibility of the window 20 to the center portion 115 of the conductive coating 52 and a very high concentration of heat at the end 76 and the end 78 of the bus bars 66 and 68, respectively, which can result in overheating of the interlayer adjacent to the heatable member 32 (see FIG. 2).

It was concluded that the non-uniform heating problem was the result of the electric current taking the path of least resistance, which in this case is the current path with the shortest length. With continued reference to FIG. 4, the current paths having the shortest distance are within the center portion 115 of the coating 52 which is a rectangle defined by the sides 112, 114 116 and 118. The side 116 of the center portion 110 has a length measured from the end 76 of the bus bar 66 to a position 120 on the bus bar 66 spaced from the end 75 of the bus bar 66 and at the intersection point of the imaginary line 112 and the bus bar 66. The side 118 of the center portion 110 has a length measured from the end 78 of the bus bar 68 to a position 122 on the bus bar 68 spaced from the end 79 of the bus bar 68 and at the intersection point of the imaginary line 114 and the bus bar 68. In one non-limiting embodiment of the invention, the imaginary lines 112 and 114 are normal to the longitudinal axis of the bus bar 66 and 68 such that the corners of the center portion 115 are each 90 degrees.

Figure 3:
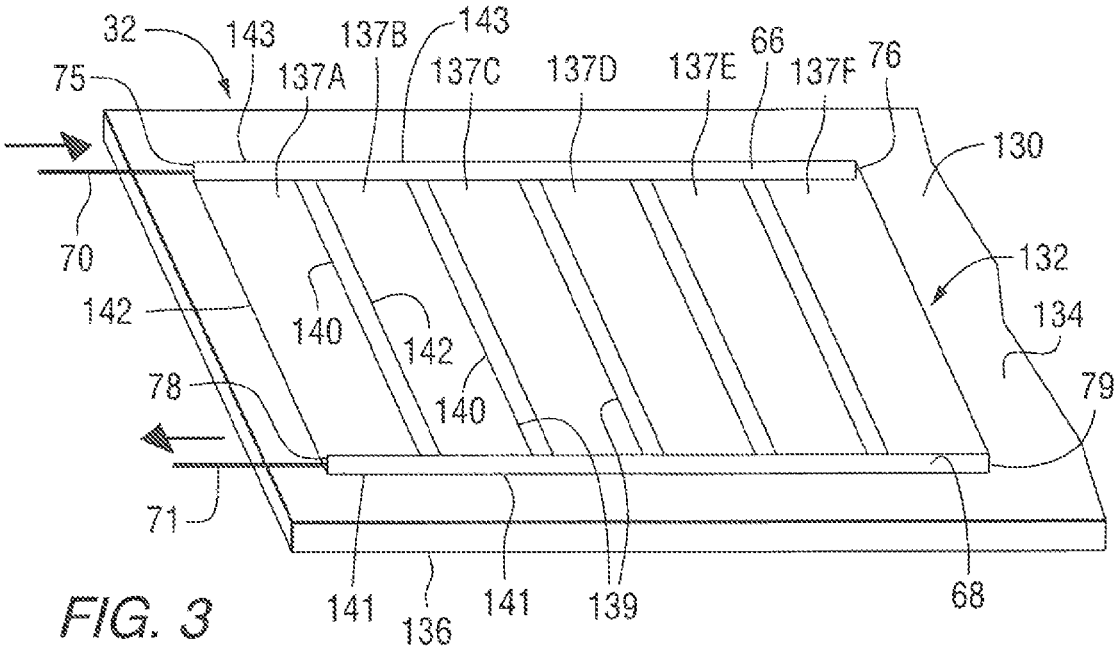
FIG. 3 is an isometric view of a non-limiting embodiment of a heating member of the invention.

With reference to FIG. 3, there is shown a non-limiting embodiment of a heatable member 32 of the invention. The heatable member 32 of the invention includes a glass sheet 130 having a segmented electrically conductive coating 132 on surface 134 of the glass sheet 130 between, and in electrical contact, with the pair of spaced bus bars 66, 68. The surface 134 of the glass sheet is opposite to surface 136, and in this embodiment of the invention is also the outer surface 46 of the windshield 20 (see FIG. 2). Each of the bus bars 66 and 68 are connected by the wire 70 and 71, respectively, to the electrical power source 72 (see FIG. 4), to flow current through the bus bars 66 and 68, and segments 137A-137F of the segmented conductive coating 130 to heat the segmented conductive coating 132, and the sheet 130 to prevent the formation of fog and/or ice on, and to remove ice and/or fog from, the outer surface, e.g. the surface 136 of the windshield 20 (see FIGS. 2 and 3).

The invention is not limited to the design and/or construction of the bus bars 66 and 68, and any of the types of bus bars used in the art can be used in the practice of the invention. Examples of bus bars that can be used in the practice of the invention, include, but are not limited to, the types disclosed in U.S. Pat. Nos. 4,623,389; 4,894,513; 4,994,650, and 4,902875, which patents in their entirety are hereby incorporated by reference. In the preferred practice of the invention, the bus bars are fired on silver ceramic glass frit, e.g. of the type disclosed in U.S. Pat. No. 4,623,389.

Further, the invention is not limited to the composition of the segmented conductive coating 132, for example and not limiting to the invention, the conductive coating 132 can be made from any suitable electrically conductive material. Non-limiting embodiments of conductive coatings that can be used in the practice of the invention include, but are not limited to, a pyrolytic deposited fluorine doped tin oxide film of the type sold by PPG Industries, Inc. under the trademark NESA®; a magnetron sputter deposited tin doped indium oxide film of the type sold by PPG Industries, Inc under the trademark NESATRON®; a gold film deposited by the physical vapor deposition process, e.g. evaporation, and a coating made up of one or more magnetron sputter deposited films, the films including, but not limited to a metal film, e.g. silver between metal oxide films, e.g. zinc oxide and/or zinc stannate, each of which can be applied sequentially by magnetron sputtering, e.g. as disclosed in, but not limited to, U.S. Pat. Nos. 4,610,771; 4,806,220 and 5,821,001. The disclosures of U.S. Pat. Nos. 4,610,771; 4,806,220 and 5,821,001 in their entirety are hereby incorporated by reference.

The non-limiting embodiment of the invention shown in FIG. 3 includes the bus bars 66 and 68 parallel to one another, having the same length and having the ends 75 and 76 of the bus bar 66, and the ends 78 and 79 of the bus bar 68 offset from one another. As stated above, the boundaries of the ends of the bus bars are defined as an imaginary line extending from an end of a bus bar toward the other bus bar and normal to the longitudinal axis of the bus bar having the end. With this arrangement and as shown for the non-limiting embodiment of the invention shown in FIG. 3, the end 75 of the bus bar 66 is to the left of the end 78 of the bus bar 68; the end 78 of the bus bar 68 is to the right of the end 75 of the bus bar 66; the end 76 of the bus bar 68 is to the left of the end 79 of the bus bar 68, and the end 79 of the bus bar 68 is to the right of the end 76 of the bus bar 66.

The segmented electrically conductive coating 132 of the invention are separated by separation lines 139 in accordance to the invention uniformly heats the coating between the bus bars 66 and 68 by providing each of the segments 137A-137E of the coating 132 with similar if not identical current path lengths. In this manner, there is uniform heating of the segments 137A-137E and uniform heating of the segmented coating 132. The invention is not limited to the number of coating segments 137A-137E between the bus bars; however, in the preferred practice of the invention, the width of the segments 137A-137E is selected such that there is no straight current path within the segments 137A-137E that is equal to or shorter than the length of the imaginary line between the bus bars 66 and 68. In other words, the straight current paths of each of the segments 137A-137E are longer than the length of an imaginary line normal to the longitudinal axis of the bus bars, e.g. see imaginary lines 112 and 114 in FIG. 4.

Figure 5:
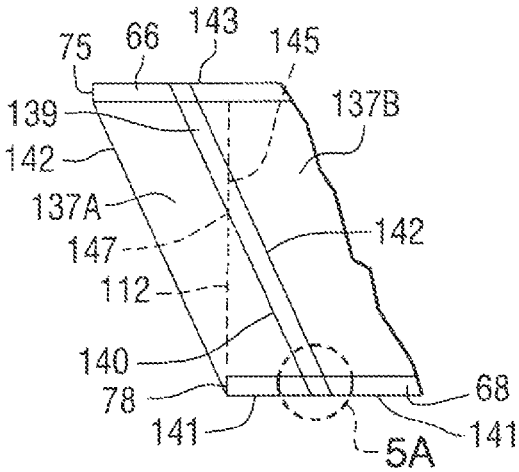
FIG. 5 is a fragmented view of a non-limiting embodiment of a heatable member of the invention.

More particularly, and with continued reference to FIG. 3, each segment 137A-137E includes four sides 140-143 (only the sides of the segments 137A and 137B are marked in FIG. 3). The length of the sides 140 and 142 define the length of the segments, and the sides 141 and 143 define the width of the segments 137A-137E. The width of each segment 138A-137E is selected such that an imaginary line normal to the longitudinal axis of one of the bus bars, e.g. the bus bar 68 extends from one corner of one of the segments 138A-138E of the coating 132 toward the opposite bus bar, e.g. the bus bar 66 and crosses over the side of an adjacent segment before extending to the opposite bus bar. More particularly and with reference to FIG. 5, in one non-limiting embodiment of the invention, the imaginary line 112 normal to the longitudinal axis of the bus bar 68 extends from the end 78 of the bus bar 68, which is a corner of the segment 137A between the sides 140 and 141 of the segment 137A toward the bus bar 66 or opposite corner of the segment 137A between the sides 140 and 143 of the segment 137A. The imaginary line 112 crosses over the side 140 of the segment 137A at crossing point 147 and optionally the side 142 of the segment 137B at crossing point 145 before contacting the bus bar 66.

Figure 6:
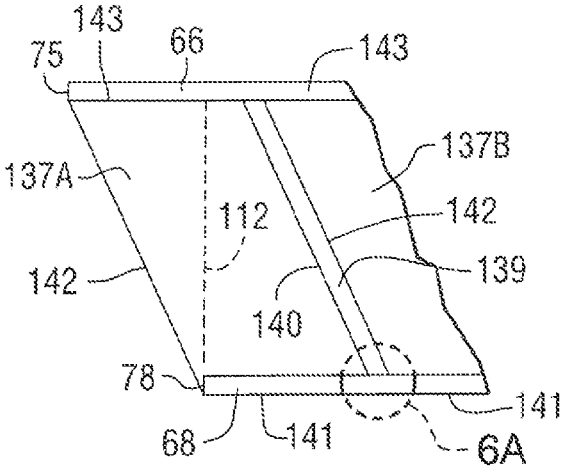
FIG. 6 is a fragmented view of another non-limiting embodiment of a heatable member of the invention.

In another non-limiting embodiment of the invention, the temperature difference between portions of the coating 52 outside of the center portion 115 (see FIG. 4) are reduced to a lesser extent than by the preferred practice of the invention discussed above. In this non-limiting embodiment of the invention, the coating 132 is segmented to provide the segments 137A-137E with a width such that an imaginary line normal to the longitudinal axis of one of the bus bars, e.g. the bus bar 68 extends from one corner of the bus bar to the opposite bus bar and stays within the sides of the segment. More particularly and with reference to FIG. 6, in this non-limiting embodiment of the invention, the imaginary line 112 is normal to the longitudinal axis of the bus bar 68, extends from the end 78 of the bus bar 68, which is the corner of the segment 137A between the sides 141 and 142 of the segment 137A toward the bus bar 66 or the opposite corner of the segment 137A between the sides 140 and 143 of the segment 137A, stays within the sides 140-143 of the segment 137A and contacts the bus bar 66 or the side 143 of the segment 137A. The measured distance from the corner between the sides 142 and 143 of the segment 137A to the intersection of the side 143 of the segment 137A and the imaginary line 112 in this non-limiting embodiment of the invention is in the range of 75 to 100% of the measured length of the side 143 of the segment 137A, and preferably in the range of 85 to 100%.

As can now be appreciated, the discussion above regarding the sides 141 and 143 of the segment 137A and the imaginary line 112 is applicable to the sides 141 and 143 of the segments 137B-137F, unless indicated otherwise.

Figure 7:
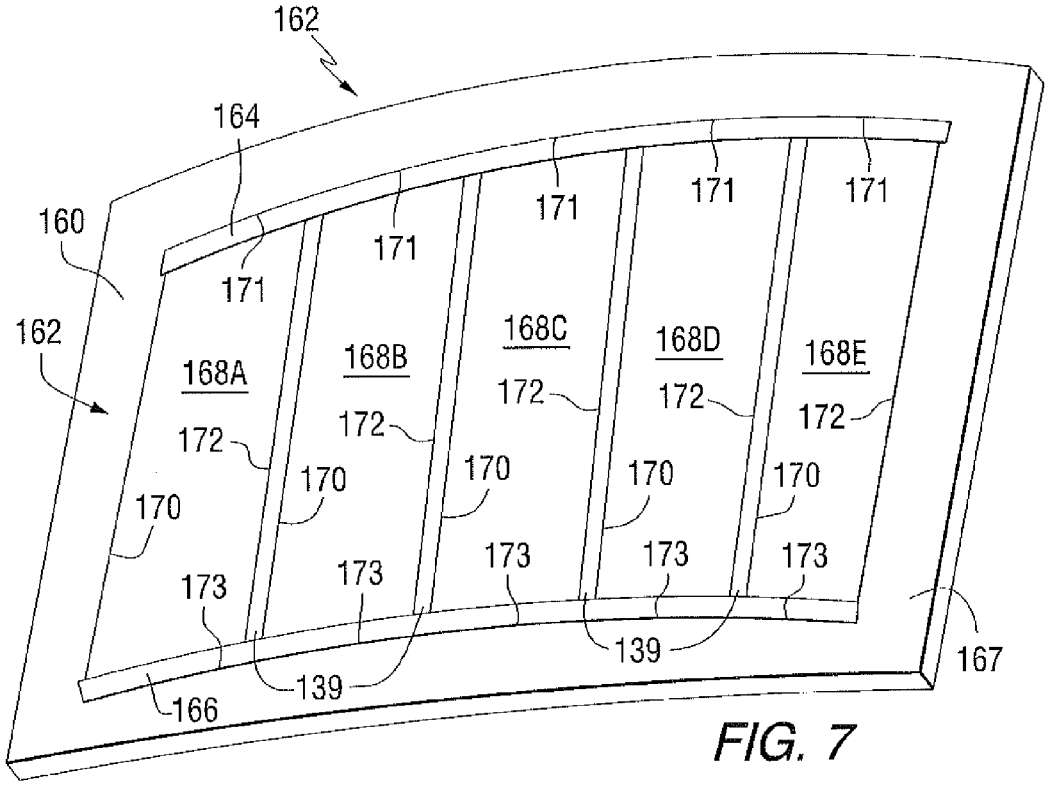
FIG. 7 is a view similar to the view of FIG. 3 showing another non-limiting embodiment of a heating member of the invention.
Figure 8:
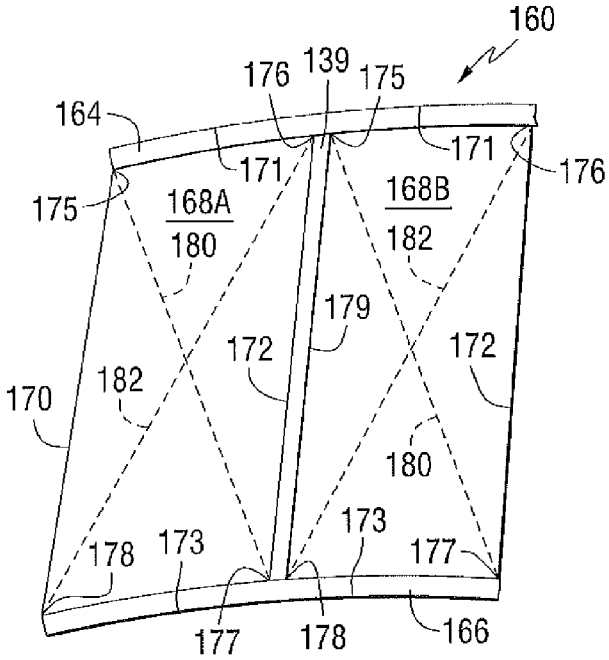
FIG. 8 is an enlarged view of two segments of the heating member shown in FIG. 7.

With reference to FIGS. 7 and 8, there is shown another preferred non-limiting embodiment of the invention. In this embodiment, heatable member 160 includes an electrically conductive coating 162 between and contacting a pair of spaced bus bars 164 and 166 applied to an acrylic sheet 167. The bus bars 164 and 166 are offset from one another, non-parallel to one another and having different lengths. The electrically conductive coating 162 includes segments 168A-168E. Each of the segments 168A-168E have sides 170-173 and corners 175-178 (corners shown only for segments 168A and 168B, and shown only in FIG. 8). The sides 170 and 172 face one another, and the sides 171 and 173 face one another. A diagonal 180 extends from the corner 175 to the corner 177, and a diagonal 182 extends from the corner 176 to the corner 178. The longer diagonal of the segment e.g. the diagonal 182 is referred to as the major diagonal, and the smaller diagonal, e.g. the diagonal 180 of the segment is referred to as the minor diagonal.

Figure 9:
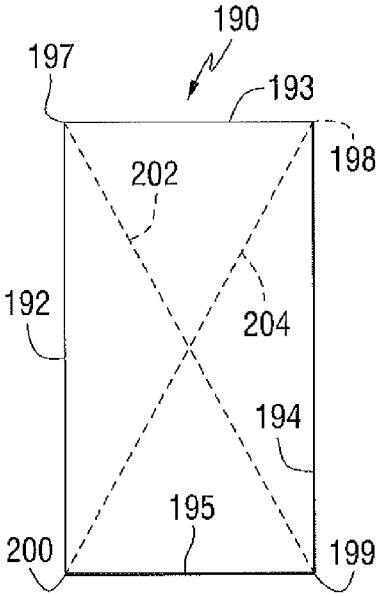
FIG. 9 is a plane view of a parallelogram shaped electroconductive segment used in the discussion of the heating member shown in FIG. 7

Shown in FIG. 9 is a coating segment 190 having a parallelogram shape having sides 192-195 and corners 197-200. The opposite sides 192 and 194, and 193 and 195 are parallel to one another. As can now be appreciated, the current moving between parallel sides of the segment 190 travels the same distance and has the same density, and uniformly heats the segment. The parallelogram can be defined by the ratio of the diagonals. More particularly, the ratio of the diagonals is 1. In the practice of this non-limiting embodiment of the invention, the ratio of the major diagonal to the minor diagonal is in the range of greater than 1 to less than 1.25, preferably in the range of greater than 1 to less than 1.15, more preferably in the range of greater than 1 to 1.05 and most preferably in the range of greater than 1 to 1.02. As can now be appreciated as the ratio of the major diagonal to the minor diagonal approach 1 the segments act as a segment having a parallelogram shape.

The invention is not limited to the manner of imposing separation lines 139 to electrically isolate the segments 137A-137E and 168A to 168E from one another. More particularly, the separation lines 139 between the segments 137A-137E and 168A-168E can be provided by abrading the coating to impose a separation between the segments, using masks during the coating process to provide the separation between the segments. In the preferred practice of the invention a continuous coating, e.g. the coating 132 (see FIG. 3) was applied to the surface 134 of the glass 130, and a laser, e.g. of the type disclosed in U.S. Patent Application Publication No. 2010/0159251 A1, used to impose separation lines 139 to provide the segments of the invention. U.S. Patent Application Publication No. 2010/0159251 A1 in its entirety is hereby incorporated by reference.

Figure 5A:
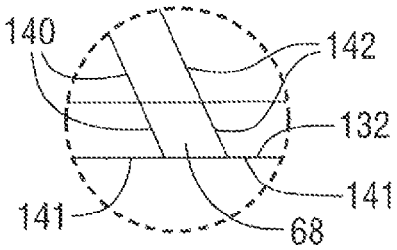
FIG. 5A is an enlarged view of the heatable member of FIG. 5 showing a portion of an electrically conductive coating on a bus bar in accordance to a non-limiting embodiment of the invention.
Figure 6A:
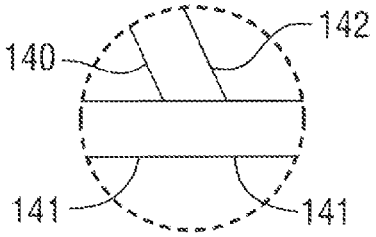
FIG. 6A is an enlarged view of the heatable member of FIG. 6 showing a portion of an electrically conductive coating on a bus bar in accordance to another non-limiting embodiment of the invention.

With reference to FIGS. 5A and 6A, the invention contemplates removing the coating 132 (FIG. 3) or coating 162 (FIG. 7) on the bus bar, e.g. the bus bar 68 as shown in FIG. 5A to completely separate the segments 137A-137E along the adjacent sides 140 and 142. The invention also contemplates leaving the coating on the bus bar as shown in FIG. 6A. Although not limiting to the invention, it is preferred in the practice of the invention to have the separation lines 139 extend over the bus bars as shown in FIG. 5A. In this manner each of the segments are completely separated from one another along the sides 140 and 142 (FIG. 3) and sides 170 and 172 (FIG. 7). Further, in the practice of the invention, it is preferred that the separation line 139 between the sides 140 and 142 of the segments 137A to 137F (FIG. 3), and the sides 170 and 172 of the segments 168A to 168E (FIG. 7) is large enough to prevent arcing between the segments. In the practice of the invention, it is preferred for the separation line 139 to have a length in the range of greater than 0 to less than 0.016 inch (0.04 centimeters), and preferably less than 0.002 inch (0.005 centimeters).

In one non-limiting embodiment of the invention, the invention was practiced on an aircraft windshield having a heatable member 32 having bus bars 66 and 68. The bus bars each had a length of 17 inches; the end 75 was 14 inches to the left of the end 78 of the bus bar 68, and the bus bars were parallel to one another and spaced 18 inches apart. A coating 132 of gold was applied on the surface 134 of an acrylic sheet 130 and a laser used to apply separation lines 139 to provide 28 segments between the bus bars. The coating on the bus bars was removed as shown in FIG. 5A. The length of each side 140 and 142 of the segments was 23 inches, and the length of each side 141 and 143 of the segments was 0.6 inches.

A voltage of 115 volts was applied between the bus bars 66 and 68, and the coating 132 demonstrated a temperature uniformity within 10° F. across the entire heated area.

The invention is not limited to the embodiments of the invention presented and discussed above which are presented for illustration purposes only, and the scope of the invention is only limited by the scope of the following claims and any additional claims that are added to applications having direct or indirect linage to this application.

What is claimed is:

1. In an improved laminated aircraft window having a first surface defined as an outer major surface and an opposite second surface defined as an inner major surface, a first side opposite to and spaced from a second side, a third side opposite to and spaced from a fourth side, with the first side joined to the third side at a first corner, the third side joined to the second side at a second corner, the fourth side joined to the second side at a third corner, and the fourth side joined to the first side at a fourth corner to provide the laminated aircraft window with a four sided configuration, a heatable member between the inner and outer major surfaces of the laminated aircraft window, wherein when the heatable member is energized to heat the outer major surface of the laminated aircraft window ice, snow and/or fog on the outer major surface of the window is melted, wherein the heatable member is securely mounted on a supporting surface, the supporting surface between the inner major surface and the outer major surface of the laminated aircraft window, the heatable member comprising a first continuous bus bar spaced from a second continuous bus bar, and a continuous electrically conductive coating between and in electrical contact with the bus bars, the first end of the first bus bar adjacent to and spaced a first distance from the first side of the laminated aircraft window and the second end of the first bus bar adjacent to and spaced a second distance from the second side, the first end of the second bus bar adjacent to and spaced a third distance from the first side of the window, and the second end of the second bus bar adjacent to and spaced a fourth distance from the second side of the window, wherein each of the first and second bus bars define a continuous path from adjacent the first side to adjacent the second side of the laminated aircraft window, wherein the first distance is greater than the third distance and the fourth distance is greater than the second distance to the first and the second ends of the first and second bus bars; wherein the continuous electric coating between the bus bars and the offset between ends of the bus bars provides for the non uniform heating of the outer major surface of the laminated aircraft window, the improvement comprises:

the outer surface of the laminated aircraft window is a first surface of a glass sheet, the glass sheet having an opposite second surface, wherein the opposite second surface of the glass sheet is the supporting surface for the bus bars and the electrically conductive coating and the electrically conductive coating of the improved laminated aircraft window comprising a plurality of electrically conductive segments, each of the segments comprising a first segment side and an opposite second segment side, wherein the first segment side of each of the segments is in electrical contact with the first bus bar, the second segment side of each of the segments is in electrical contact with the second bus bar, and portions of each of the segments between the first bus bar and the second bus bar in spaced relationship to one another to prevent electrical contact between adjacent ones of the segments between the bus bars, wherein each of the segments has a major diagonal and a minor diagonal, and, wherein the major diagonal has a length different from the length of the minor diagonal such that a ratio of the length of the major diagonal to the length of the minor diagonal is in the range of greater than 1 to 1.25, wherein the first side of each of the segments is connected to the first bus bar, and the second side of each of the segments is connected to the second bus bar, wherein the ratio of the length of the major diagonal to the length of the minor diagonal in the range of greater than 1 to 1.25 sets the first and the second corners of each of the segments off set from their respective ones of the third corner and fourth corner of each of the segments to provide a plurality of segments of electrically conductive coatings wherein the segments of the coating are similar to one another such that energizing the heating member of the improved laminated aircraft window uniformly heats the outer surface of the laminated aircraft window to melt snow, ice and/or fog from the outer surface of the window.

2. The aircraft window according to claim 1, wherein the first bus bar and the second bus bar have different lengths and are non-parallel to one another, wherein the first, second, third and fourth sides of each segment defines a perimeter of its respective segment, the plurality of segments comprises a first segment and an adjacent segment defined as a second segment, and the fourth side of the first segment is in facing relationship to and spaced from the third side of the second segment, wherein the first side of the first and the second segments overlays the first bus bar and the second side of the first and the second segments overlays the second bus bar, and a straight imaginary line normal to the longitudinal axis of the first bus bar defines a path that extends from a corner between the first side end the third side of the first segment toward the second bus bar, the path crossing over the perimeter of the first segment prior to contacting the second bus bar.

3. The aircraft window according to claim 2 wherein the fourth side of the first segment and the third side of the second segment overlaying the first bus bar are spaced from one another and the fourth side of the first segment and the third side of the second segment overlaying the second bus bar are spaced from one another.

4. The aircraft window according to claim 2 wherein the fourth side of the first segment and the third side of the second segment overlaying the first bus bar are in contact with one another and the fourth side of the first segment and the fourth side of the second segment overlaying the second bus bar are in contact with one another.

5. The aircraft window according to claim 1, wherein the first bus bar and the second bus bar have different lengths and are non-parallel to one another, the first and the second bus bars each has a longitudinal axis extending from their first end to their second end, wherein the first, second, third and fourth sides of each segment defines a perimeter of its respective segment, the plurality of segments comprises a first segment and an adjacent segment defined as a second segment, and the fourth side of the first segment is in facing relationship to and spaced from the third side of the second segment, wherein the first side of the first and the second segments overlays the first bus bar and the second side of the first and the second segments overlays the second bus bar, and a straight imaginary line normal to the longitudinal axis of the first bus bar defines a path that extends from a corner between the first side and the third side of the first segment toward the second bus bar and crosses over the perimeter of the first segment at the second side defined as a crossing point, wherein a distance from a corner between the second side and the third side and the crossing point at the second side is in the range of 75-100% of the length of the second side as measured between the third side and the fourth side of the first segment at the second bus bar.

6. The aircraft window according to claim 1, wherein the first bus bar and the second bus bar have the same length, are parallel to one another, and each has a longitudinal axis extending from their first end to their second end, wherein the first, second, third and fourth sides of each segment defines a perimeter of its respective segment, the plurality of segments comprises a first segment and an adjacent segment defined as a second segment, and the fourth side of the first segment is in facing relationship to and spaced from the third side of the second segment, wherein the first side of the first and the second segments overlays the first bus bar and the second side of the first and the second segments overlays the second bus bar, and a straight imaginary line normal to the longitudinal axis of the first bus bar defines a path that extends from a corner between the first side and the third side of the first segment toward the second bus bar, the path crossing over the perimeter of the first segment prior to contacting the second bus bar.

7. The aircraft window according to claim 1, wherein the first bus bar and the second bus bar have the same length and are parallel to one another, the first and the second bus bars each has a longitudinal axis extending from their first end to their second end, wherein the first, second, third and fourth sides of each segment defines a perimeter of its respective segment, the plurality of segments comprises a first segment and an adjacent segment defined as a second segment, and the fourth side of the first segment is in facing relationship to and spaced from the third side of the second segment, wherein the first side of the first and the second segments overlays the first bus bar and the second side of the first and the second segments overlays the second bus bar, and a straight imaginary line normal to the longitudinal axis of the first bus bar defines a path that extends from a corner between the first side and the third side of the first segment toward the second bus bar and crosses over the perimeter of the first segment at the second side defined as a crossing point, wherein a distance from a corner between the second side and the third side and the crossing point at the second side is in the range of 75-100% of the length of the second side of the first segment as measured between the third side and the fourth side at the second bus bar.

8. The aircraft window according to claim 1 wherein the heatable member is a component of a transparency for a land vehicle; of a canopy, cabin window and windshield for an air and space vehicle, of a window for above or below water vessel, and of a window for a viewing side or door for containers.

9. The aircraft window according to claim 1 wherein the ratio is in the range of greater than 1 to equal to or less than 1.02.

* * * * *